US005893483A

United States Patent [19]

Duran

[11] Patent Number: 5,893,483

[45] Date of Patent: Apr. 13, 1999

[54] PERSONAL HAND-HELD PROTECTION DEVICE

[76] Inventor: Julian Keith Duran, 3015 S. Ocean Blvd., Apt. 9A, Highland Beach, Fla. 33487

[21] Appl. No.: 08/784,360

[22] Filed: Jan. 17, 1997

[51] Int. Cl.[6] ..... B67D 5/32

[52] U.S. Cl. ..... 222/39; 222/78; 222/113; 222/175; 362/102; 206/38.1; 42/1.08

[58] Field of Search ..... 222/39, 78, 153.11, 222/175, 192, 402.11, 113; 42/1.08, 1.16; 116/77; 362/102, 109; 340/574; 206/38.1

[56] References Cited

U.S. PATENT DOCUMENTS

| | | | |
|---|---|---|---|
| 4,408,844 | 10/1983 | Schoolman | 351/158 |
| 4,946,030 | 8/1990 | Guridi et al. | 206/38.1 X |
| 5,383,343 | 1/1995 | Thach | 63/1.1 |
| 5,517,180 | 5/1996 | Masi et al. | 340/574 X |
| 5,549,220 | 8/1996 | Whalen | 222/113 X |
| 5,556,003 | 9/1996 | Johnson et al. | 222/39 |

*Primary Examiner*—Gregory L. Huson

[57] ABSTRACT

The personal protection device described herein has a deterrent spray feature, a flashlight, a siren, and a key holder. The personal hand-held protection device comprises a roughly L-shaped main body portion including a hand grip with individually recessed finger rests. A knuckle guard portion attached at two points to the main body portion protects a user's knuckles as the user's fingers grasp the hand grip. A light and spray nozzle are disposed at a first end of said main body portion and aim generally in the same direction so the user can illuminate the area where he is directing deterrent spray or colored dye. Mounted in the main body potion is a siren for emitting a loud noise. Also contained in the main body portion are a battery compartment for storing batteries to energize the light and siren, and a reservoir for storing the deterrent spray or colored dye. Triggers are provided in the hand grip for switching the siren and light on and off, and a thumb-operated trigger pump for spraying deterrent fluid is mounted at a first end of the main body portion on a side opposite from the light and spray nozzle.

10 Claims, 2 Drawing Sheets

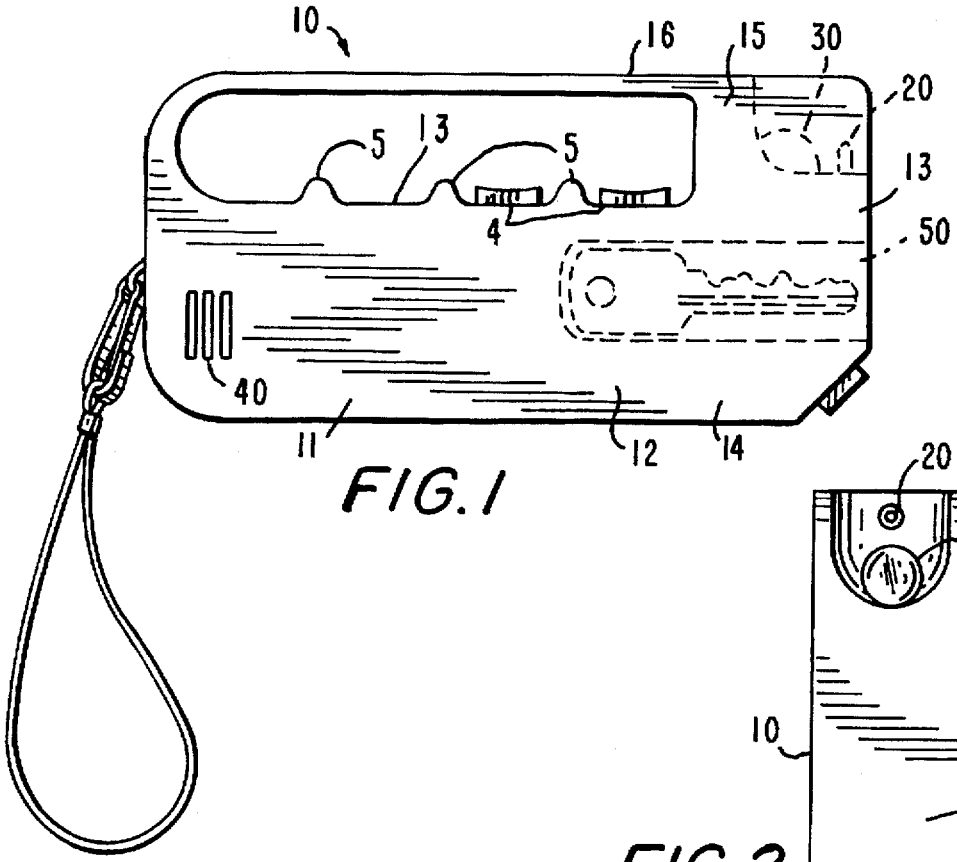
FIG. 1
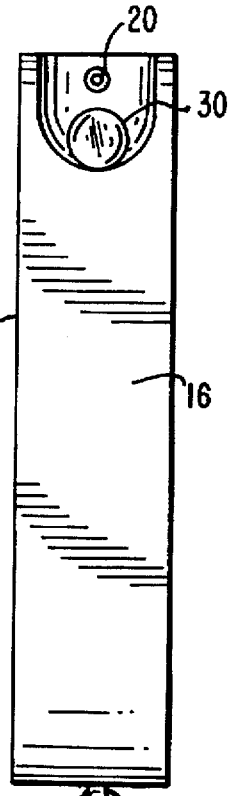
FIG. 2
FIG. 3
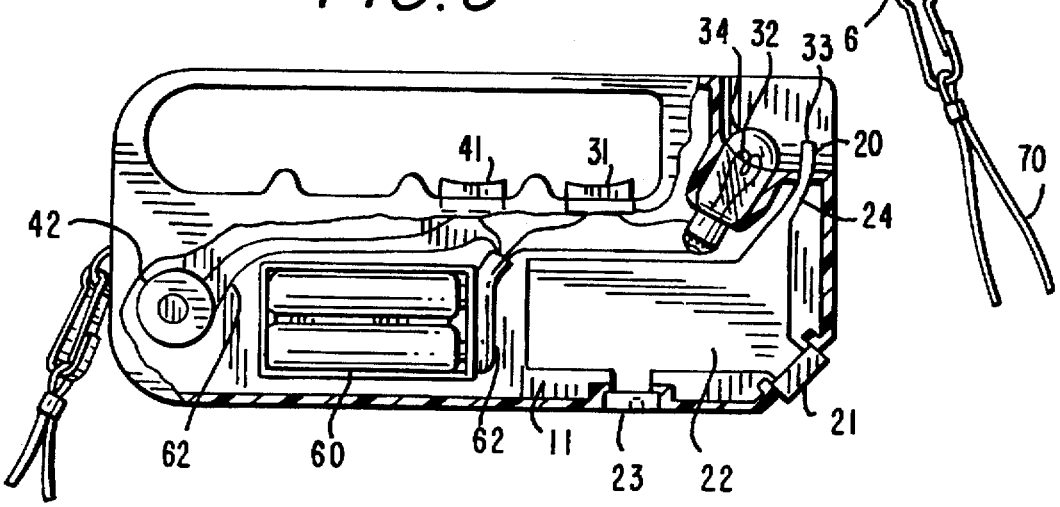

PERSONAL HAND-HELD PROTECTION DEVICE

BACKGROUND OF THE INVENTION

The invention relates generally to devices used for self-defense and more particularly to small, hand-held self-defense devices having a multiplicity of features.

Personal safety has become increasingly important as public safety conditions have deteriorated, particularly in urban centers, and people have assumed greater responsibility for their own safety. In response to this trend, many personal self-defense devices have entered the marketplace. Some of these devices have combined the features of traditionally separate devices. For instance, deterrent sprays have been incorporated in combination with other personal safety devices like billy clubs, or flashlights.

These prior art devices, however, suffered from several drawbacks that limit their effectiveness as personal protection devices. Often the resulting combinations are large, heavy and difficult to conceal, making them inconvenient to carry. Many of the combinations do not include features which would maximize their effectiveness or extend their usefulness beyond personal safety and into the daily routine of the user.

The device of the present invention overcomes the limitations of these prior art devices by combining many useful features in a compact, light, hand-held and readily concealable package. Additionally, the inventive device includes features which extends the utility of the device beyond personal safety and makes it a convenient device to carry for daily living.

It is an object of the invention to provide a compact, hand-held device for use in personal defense that is lightweight, uncomplicated and inexpensive to manufacture.

It is an additional object of the invention to provide a compact, hand-held device useful in a person's daily tasks tat can also be used for personal defense. These and other objects will be apparent to those skilled in the art upon a reading of the present disclosure in conjunction with the drawings.

SUMMARY OF THE INVENTION

The invention is directed to a personal protection device comprising a housing capable of being hand-held which includes a main body portion and a gripping portion disposed on the outside surface of said main body portion, a light means for emitting light located in said housing, a spraying means for spraying a deterrent fluid located in said housing, a siren, a keyholder, and a triggering means for activating said light means, spray means and siren. Preferably, the main body portion is in the shape of or comprises a knuckle protector for shielding the knuckles of the user's hands.

BRIEF DESCRIPTION OF THE DRAWINGS

FIG. 1 is a plan view of a personal hand-held protection device made in accordance with the invention;

FIG. 2 is an alternate plan view of the personal hand-held protection device depicted in FIG. 1; and FIG. 3 is a partial cut-away view showing the internal components comprising the invention.

DETAILED DESCRIPTION OF THE PREFERRED EMBODIMENTS

Figure 4:
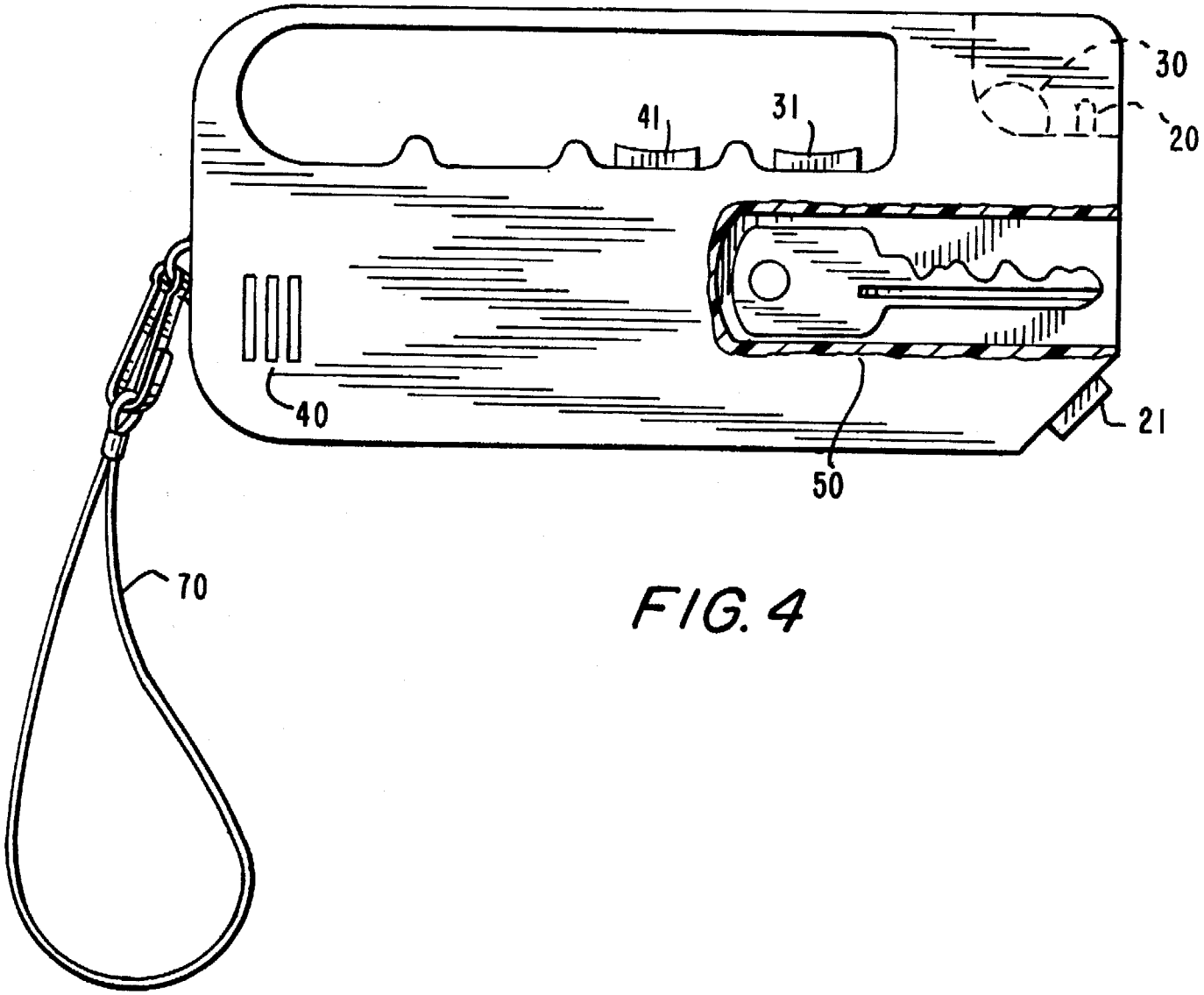
FIG. 4 is an overall view of the personal hand-held protection device depicted in FIGS. 1–3.

In general, the invention relates to a compact, self-contained, hand-held device for use in deterring and/or disabling attackers. The personal, hand-held protection device of the invention preferably incorporates a key holder, hand protector/knuckle enhancer, flashlight, siren, deterrent spray and wrist carrying loop.

The present section details the preferred embodiments of the subject invention. These embodiments are set forth to illustrate the invention, but are not to be construed as limiting. Since this disclosure is not a primer on protection devices or their manufacture, basic concepts known to those skilled in the art have not been set forth in detail. Concepts such as choosing the proper material and manufacturing techniques for constructing devices encompassing the present invention are readily determinable by those skilled in the art. Attention is directed to the appropriate texts and references known to those in the art for details regarding these and other basic concepts which may be necessary in the practice of the present invention.

The device of the present invention may be used in a variety of situations and in various ways. Typically, the user of the device when faced with an assailant in a threatening situation would first illuminate an assailant with the flashlight and then energize the siren to discourage the assailant. Should these measures prove ineffective, the user could also spray the assailant with a deterrent liquid. If all of these successive measures fail, the user may also use the device as an aid in attacking the assailant or blocking attacks by the assailant.

The personal hand-held protection device of the invention may be provided in a variety of shapes. Preferably, the device is roughly L-shaped or gun-shaped with its main body portion, including a hand grip with individually recessed finger rests, capable of being held easily in the palm of the hand. In the preferred embodiments, a knuckle guard portion is attached at two points to the main body portion in order to protect the user's knuckles as the user's fingers grasp the hand grip. This preferred design facilitates the use of the device as an aid in attacking an assailant by providing knuckle protection and a hard surface to increase the deterrent effect of a punch.

It is desirable to have a light and spray nozzle disposed at a first end of said main body portion and aim generally in the same direction so that the user can illuminate the area where he or she is directing deterrent spray or colored dye. It may also be desirable to mount in the main body portion a siren for emitting a loud noise.

A battery compartment for storing batteries to energize the light and siren and a reservoir for storing the deterrent spray or colored dye is also typically included in the main body. Triggers are provided preferably in the hand grip for switching the siren and light on and off, and a thumb-operated trigger pump is preferred for spraying the deterrent fluid A key holder for spare keys or a coin holder may also be machined in the main body portion to increase the utility of the device beyond personal safety.

The main body portion and knuckle protector may be constructed from a variety of materials. For instance, aluminum alloys may be used, such as 2024-T4, 3003-H14 or 6061-T6511, which would provide a high tensile strength and good corrosion resistance. These alloys also would provide a rugged, lightweight structure ideal for the invention's intended environment. Alternatively, the protection device could be constructed from a high-impact polycarbonate or PVC plastic material.

Of course, the device of the present invention may be made in various colors, sizes and shapes, including the L-shape as shown in the figures or a U-shape for additional protection of the fingers of the user or a cylindrical shape for additional convenience.

The batteries used in the present invention may be standard disposable batteries or rechargeable batteries, such as nickel cadmium batteries, or long lasting lithium-based batteries. The triggering means for the siren and flashlight will typically be an electrical trigger or switch. The triggering means for the spray may be an electrical or mechanical pump type trigger. The spray or deterrent fluid may be mace, pepper gas, a dye, etc. which will deter the approach of a assailant and/or mark the assailant for later identification by the police.

Various other features may be incorporated into the device of the present invention. Time pieces, such as a watch, pen knives, nail files, key hole defrosters, personal recorders, radios, etc. may be easily incorporated into the subject device to increase its utility for the user. Other personal safety features may also be included, such as an electrical stunner for providing a mild electrical shock to an assailant. These and other embodiments of the present invention will become apparent to those skilled in the industry.

The present invention will now be described by reference to the figures. FIGS. 1–4 depict a personal protection device 10 made in accordance with the invention. The personal protection device 10 comprises a deterrent spray nozzle 20, a flashlight 30, a siren vent 40, a keyholder 50 and a wrist strap 70. These features are incorporated in main body portion 11. Main body portion 11 is roughly L-shaped and comprises a larger, roughly rectangular solid section 12 and a smaller, roughly rectangular solid section 13. The smaller section 13 is disposed at a first end 14 of said larger section 12. Located at a first end 15 of said smaller section 13 are the deterrent spray nozzle 20 and flashlight 30. The deterrent spray nozzle 20 and flashlight 30 aim in the same direction. This allows the user to illuminate the area where he is spraying, in order to properly aim the deterrent spray at an assailant. After he has sprayed the deterrent fluid he can judge the effectiveness of the fluid in disabling the attacker by using the flashlight.

Located on the larger section 12 is a hand grip show%n generally at 13 that is comprised of four indentations which serve as finger rests 4. Between each finger rest 4 are ridges 5 that serve to separate the user's fingers as he grasps the personal, hand-held protection device and which help to ensure a positive, sure grip. Such a sure grip is essential in the tension-filled situations in which the device is to be used. Located opposite from grip 13 is a knuckle protector 16. Knuckle protector 16 shields a user's knuckles from injury should it be necessary to use the personal, hand-held protection device as a club or "brass" knuckles. Knuckle protector 16 in the preferred embodiment is formed integrally with main body portion 1, to provide a rugged construction that is resistant to damage.

The main body portion 11 and knuckle protector 16 preferably could be constructed from aluminum alloys, such as 2024-T4, 3003-H14 or 6061-T6511. These alloys would provide a high tensile strength and good corrosion resistance. These alloys also would provide a rugged, lightweight structure ideal for the invention's intended environment. In alternative embodiments, the personal protection device 10 could be constructed from a high-impact polycarbonate or PVC plastic material. These materials are durable, lightweight, have high tensile strength and are relatively inexpensive. Such materials can be injection molded. Injection molding the main body portion 11 and knuckle protector 16 would significantly simplify production of the personal, hand-held protection device 10.

FIG. 3 depicts in a partial cut-away view the inner workings of personal, hand-held protection device 10. Machined in main body portion 11 is a deterrent fluid/colored dye reservoir 22. Deterrent fluid reservoir 22 is refillable through resealable refill duct 23. The reservoir 22 is connected to spray nozzle 20 by duct 24. A pump trigger 21 imparts a pressurized charge to deterrent fluid reservoir 22 after each depressing of the pump trigger 21. This charge expels a portion of the deterrent fluid out spray nozzle 20 through duct 24.

Also contained in main body portion 11 is a battery compartment 60 for storing, for example, two "AA" batteries 61. The two "AA" batteries are connected to siren 42 and light bulb 32 by wiring 62 which is shown in schematic form that would be readily translatable to a working electrical circuit by one of ordinary skill in the art. Wiring 62 is also connected to the flashlight trigger 31 and siren trigger 41 located in two of the finger rests 13 of the grip 12.

Flashlight 30 comprises a light bulb 32, a lens/lens cap 33 and a reflector 34. Flashlight bulb 32 is mounted in a socket 35. Socket 35 is connected to the two "AA" batteries in battery compartment 60 by wiring 62. Flashlight bulb 32 preferably would be a halogen or krypton bulb. Such bulbs would provide a bright beam of light and would be long-lasting.

Siren 42 is connected to the two "AA" batteries in battery compartment 60 by wiring 62. Siren 42 could be any electromechanically operated siren that is compact in size, durable, and capable of emitting a loud noise.

In operation, this arrangement of the thumb-operated deterrent fluid pump trigger 21 and flashlight 31 and siren 41 triggers would allow the user to simultaneously operate them in a simple fashion. This ease of use is a significant advantage of the inventive personal, hand-held protection device because of the tense situations in which the device is likely to be used.

One skilled in the art will appreciate that the present invention can be practiced in various other embodiments and constructions than those described herein. The embodiments shown and described herein are not intended to, and should not be construed to, limit the claimed invention in any way. Upon a reading of the present disclosure variations of the embodiments herein will become obvious to those skilled in the art. These variations are to be considered within the spirit and scope of the subject invention, which is only limited by the following claims and their equivalents.

What is claimed is:

1. A personal protection device comprising:

(i) a housing capable of being hand-held which comprises a main body portion and a gripping portion disposed on the outside of said main body portion for providing a comfortable hand grip;

(ii) light means for emitting light disposed in said housing;

(iii) spray means for spraying a deterrent fluid or colored dye disposed in said housing;

(iv) siren means for emitting a loud noise disposed in said housing;

(v) key holder means disposed in said housing for holding keys and (vi) triggering means for activating said light means, spray means, and siren means.

2. The personal protection device of claim 1, wherein said main body portion also comprises a knuckle protector for shielding the knuckles of the user's hand while gripping the device.

3. The personal protection device of claim 2 wherein said main body portion and knuckle protector are machined from a material selected from the group consisting of plastics and aluminum alloys.

4. The personal protection device of claim 1, wherein said light means further comprises:

(i) a light assembly disposed at a first end of said main body portion; wherein said light assembly comprises a lens, reflector, light bulb and removable lens cap;

(ii) a trigger disposed in said gripping means for switching the light bulb on and off;

(iii) a battery compartment for storing a battery;

(iv) a battery for providing power to the light bulb; and wiring connecting said trigger, battery and light bulb.

5. The personal protection device of claim 4 wherein said light bulb is selected from the group consisting of halogen or krypton light bulbs.

6. The personal protection device of claim 1, wherein said siren means further comprises:

(i) a siren assembly comprising an electrically operated siren;.

(ii) a battery compartment for storing a battery;

(iii) a battery for providing power to the siren;

(iv) a trigger disposed in said gripping means for switching the siren on and off; and (v) wiring connecting said battery, trigger and siren.

7. The personal protection device of claim 1, wherein said spray means further comprises:

(i) a spray nozzle disposed at a first end of said main body portion for emitting a controlled pattern of said deterrent fluid or colored dye;

(ii) a reservoir for storing deterrent fluid, wherein said reservoir has three openings, a first opening for refilling said reservoir with said deterrent fluid or colored dye;

(iii) a duct connecting said reservoir with said spray nozzle;

(iv) a pump for providing a charge to said deterrent fluid or colored dye; and (v) a trigger for releasing said pressurized deterrent fluid or colored dye in a spray through said spray nozzle.

8. A personal protection device comprising (i) a housing comprising a main body portion and a knuckle protector, wherein said main body portion is roughly L-shaped and comprised of a longer roughly rectangular solid section and a shorter roughly rectangular solid section disposed at a first end of said longer rectangular solid section to form said L-shape, and wherein said knuckle protector is integrally joined to said solid sections, said main body portion and said knuckle protector forming a hand-sized opening;

(ii) a light assembly mounted in said smaller rectangular solid section and comprising a light bulb, a light bulb socket, a lens for shielding said light bulb and for focusing the light emitted by said light bulb, and a reflector for reflecting said light of said light bulb;

(iii) a spray nozzle and duct assembly mounted adjacent to said light assembly in said smaller rectangular solid section so that deterrent fluid or colored dye emitted from said spray nozzle travels in the same general direction as the light emitted from said light bulb;

(iv) a reservoir disposed in said main body portion for holding said deterrent fluid or colored dye, said main body portion having a resealable access port for admitting additional deterrent fluid or colored dye to said reservoir, said reservoir connected to said duct assembly in said spray nozzle and duct assembly;

(v) a thumb-operated pump and trigger mounted on said longer rectangular solid section at said first end but on a first side opposite from said smaller rectangular solid section, said thumb operated pump and trigger providing a pressurize charge to said deterrent fluid or colored dye in said reservoir to impel said fluid or dye through said duct assembly and out said spray nozzle;

(vi) an electrically operated siren mounted within said main body portion for emitting a loud noise;

(vii) a grip formed on a second surface of said longer rectangular solid section, said second surface opposite from said first surface of said longer rectangular solid section mounting said trigger and pump assembly, said grip having four individually recessed areas for providing individual finger rests;

(viii) light and siren triggers mounted within at least one of said individually recessed finger areas for switching said siren and light bulb on and off;

(xi) a battery compare for storing a battery; and (x) wiring for connecting said battery to said siren, light bulb, and siren and light triggers to provide power to energize said siren and light bulb when said siren and light triggers are in a closed position.

9. The personal protection device of claim 8 wherein said main body portion and knuckle protector are machined from aluminum alloy 2024-T4, 3003-H14 or 6061-T6511.

10. The personal protection device of claim 8 wherein said main body portion and knuckle protector are machined from high-impact polycarbonate or PVC plastic materials.

* * * * *